US007291981B2

(12) United States Patent
Kiss et al.

(10) Patent No.: US 7,291,981 B2
(45) Date of Patent: Nov. 6, 2007

(54) SHORT ARC LAMP WITH IMPROVED MANUFACTURABILITY

(75) Inventors: John Kiss, San Jose, CA (US); Dan O'Hare, Livermore, CA (US); James Hyunh, Fremont, CA (US); Rudi Blondia, Fremont, CA (US)

(73) Assignee: PerkinElmer, Inc, Waltham, MA (US)

( * ) Notice: Subject to any disclaimer, the term of this patent is extended or adjusted under 35 U.S.C. 154(b) by 258 days.

(21) Appl. No.: 10/891,956

(22) Filed: Jul. 13, 2004

(65) Prior Publication Data

US 2006/0012275 A1 Jan. 19, 2006

(51) Int. Cl.
*H01J 61/30* (2006.01)
*H01J 5/16* (2006.01)
*H01J 17/16* (2006.01)

(52) U.S. Cl. ..... 313/634; 313/113; 313/623; 313/621; 313/284

(58) Field of Classification Search ..... 313/634, 313/113, 623, 573, 570, 574, 567, 568
See application file for complete search history.

(56) References Cited

U.S. PATENT DOCUMENTS 4,232,243 A * 11/1980 Rigden ..... 313/623
4,599,540 A * 7/1986 Roberts ..... 313/570
5,539,271 A * 7/1996 Sulcs et al. ..... 313/25
5,672,931 A * 9/1997 Kiss et al. ..... 313/44
5,903,088 A * 5/1999 Sugitani et al. ..... 313/46
6,171,105 B1 * 1/2001 Sarmadi ..... 433/29
6,181,053 B1 * 1/2001 Roberts ..... 313/46
6,400,067 B1 * 6/2002 Manning et al. ..... 313/46
6,597,087 B2 * 7/2003 Roberts et al. ..... 313/113
6,670,758 B2 * 12/2003 Beech et al. ..... 313/634
2002/0050774 A1 * 5/2002 Goto et al. ..... 313/113

* cited by examiner

*Primary Examiner*—Nimeshkumar D. Patel
*Assistant Examiner*—Anthony Perry
(74) *Attorney, Agent, or Firm*—Felix L. Fischer

(57) ABSTRACT

A short arc lamp incorporates a cylindrical reflector body having a reflector cavity opening to a first end and an anode aperture through a base surface at a second end. The body has a step at the second end. A front sleeve with a step for positional engagement of a land is received over the first end of the reflector body. A cathode support is received within the second end of the front sleeve and includes a ring to engage a second oppositely oriented positioning step. A window mount received within the second end of the front sleeve abuts a front surface of the ring. A highly conductive base concentrically supporting an anode received through the anode aperture has a flange in flush abutment with the base surface for braze attachment.

26 Claims, 11 Drawing Sheets

SHORT ARC LAMP WITH IMPROVED MANUFACTURABILITY

FIELD OF THE INVENTION

This invention relates generally to the field of short arc lamps and more particularly to an improved arc lamp with reduced parts count and improved manufacturability.

BACKGROUND OF THE INVENTION

Short arc lamps provide intense point sources of light that allow light collection in reflectors for applications in medical endoscopes, instrumentation and video projection. Also, short arc lamps are used in industrial endoscopes, for example in the inspection of jet engine interiors. More recent applications have been in color television receiver projection systems.

A typical short arc lamp comprises an anode and a sharp-tipped cathode positioned along the longitudinal axis of a cylindrical, sealed concave chamber in a ceramic reflector body that contains xenon gas pressurized to several atmospheres. U.S. Pat. No. 5,721,465, issued Feb. 24, 1998, to Roy D. Roberts entitled Xenon Arc Lamp with Improved Reflector Cooling, U.S. Pat. No. 6,181,053 issued Jan. 30, 2001 to Roy D. Roberts entitled Three-kilowatt Xenon Arc Lamp and U.S. Pat. No. 6,316,867 issued Nov. 13, 2001 to Roy D. Roberts and Rodney O. Romero entitled Xenon Arc Lamp describe such typical short-arc lamps.

The manufacture of high power xenon arc lamps involves the use of expensive and exotic materials and sophisticated fabrication, welding, and brazing procedures. Reduction in parts count, assembly steps and tooling requirements provides cost savings and improved product reliability and quality.

Exemplary prior art arc lamps produced and sold under the CERMAX line of arc lamps are shown in FIGS. 1*a* and 1*b*. The first lamp 100 comprises an optical coating 102 on a sapphire window 104, a window shell flange 106, a body sleeve 108, a pair of flanges 110 and 112, a three piece strut assembly 114, a cathode 116, an alumina-ceramic elliptical reflector body 118, a metal shell or sleeve 120, a copper anode base 122, a base weld ring 124, a tungsten anode 126, a gas tubulation 128, and a charge of xenon gas 130. All of which are manufactured in brazed subassemblies which are welded together in a final assembly process. The second lamp 200 comprises an optical coating 202 on a sapphire window 204, a window shell flange 206, a body sleeve 208, a gas-fill tabulation 210 for a charge of xenon gas 212, a strut assembly 214, a cathode 216, a ceramic reflector body 218, an anode flange 220 and a tungsten anode 222.

It is desirable to reduce the parts count for manufacture of short arc lamps to reduce cycle time and improve yield. It is further desirable to eliminate tooling required for assembly and assure maximum accuracy in arc gap dimensions to assure consistent lamp operation.

SUMMARY OF THE INVENTION

A short arc lamp with improved manufacturability incorporates a substantially cylindrical ceramic reflector body having a reflector cavity opening to a first end and an anode aperture through a base surface at a second end. The body has a step at the second end. A front sleeve is closely received at a first end over the first end of the reflector body. The sleeve first end has a step for positional engagement of a land on the first end of the reflector body. The second end of the sleeve has a second positioning step oriented in opposed relation to the first step. A cathode support is received within the second end of the front sleeve and includes a ring having a second land engaging the second positioning step. A window mount received within the second end of the front sleeve abuts a front surface of the ring. A highly conductive base concentrically supporting an anode received through the anode aperture has a flange in flush abutment with the base surface for braze attachment thereto.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1B:
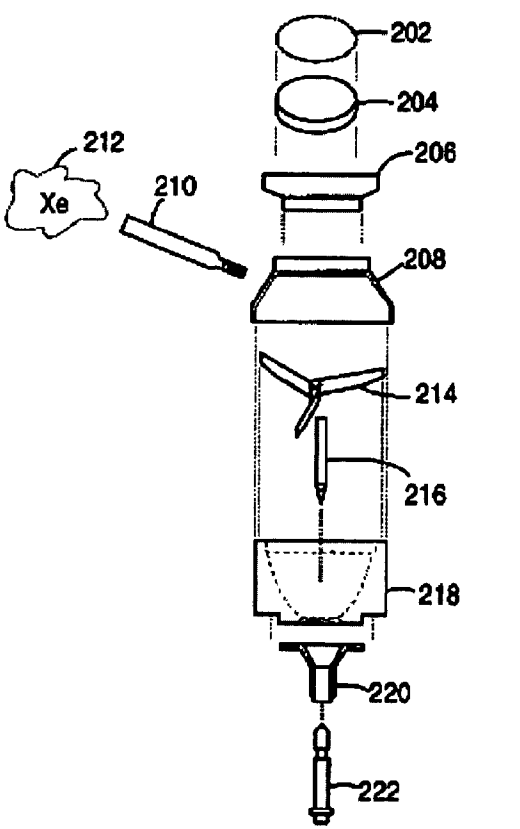
FIG. 1b Prior Art
FIGS. 1*a* and 1*b* are exploded views of the components of exemplary prior art short arc lamps.
Figure 1A:
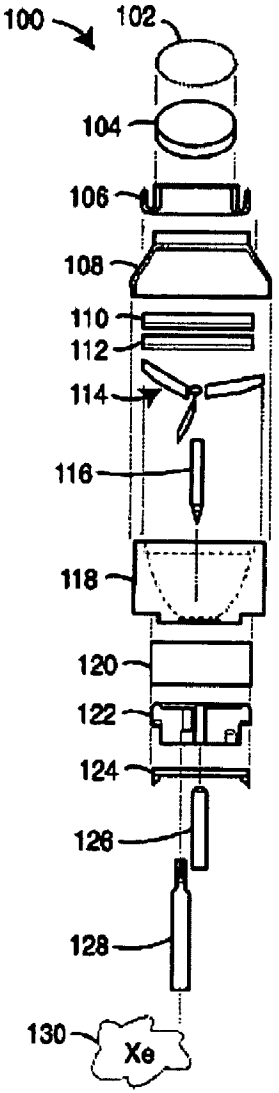
FIG. 1a Prior Art
Figure 2A:
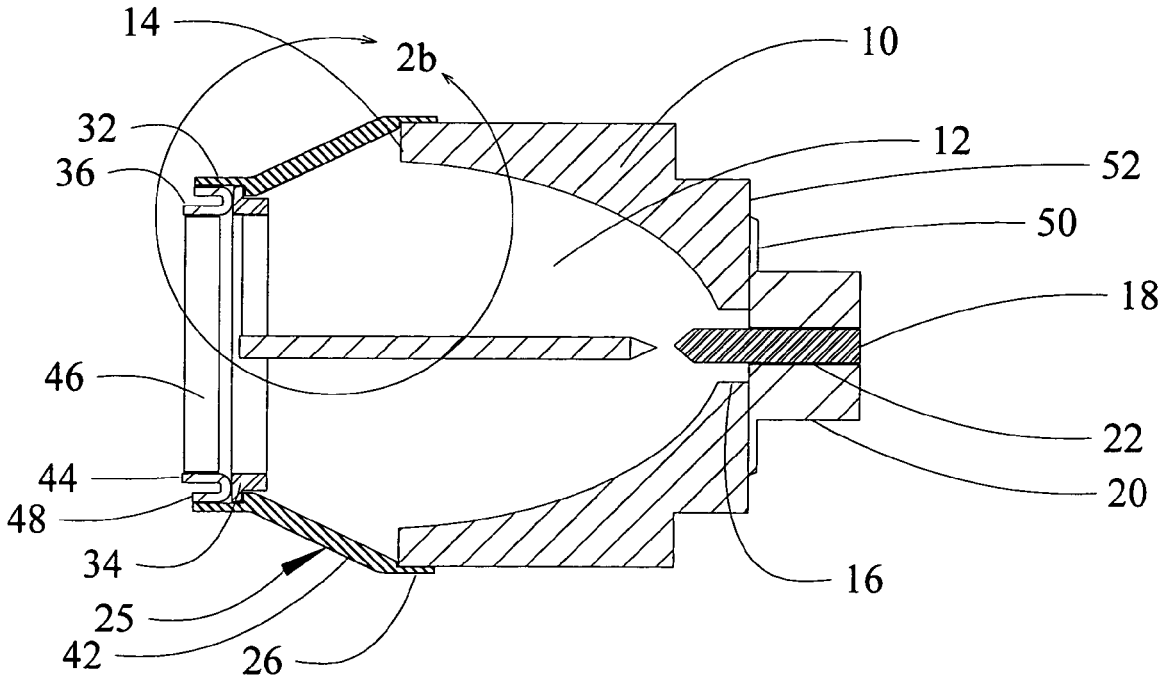
FIG. 2*a* is a side section view of a short arc lamp employing the present invention.

Referring to the drawings, FIG. 2*a* shows the short arc lamp incorporating the present invention. A ceramic reflector body 10 has a reflector cavity 12 extending from a first end 14. A second end of the body has an aperture 16 to receive an anode 18. The anode is supported by a base 20 which has an axial bore 22 which closely receives a shaft 24 of the anode to concentrically align the anode with the aperture.

Figure 2B:
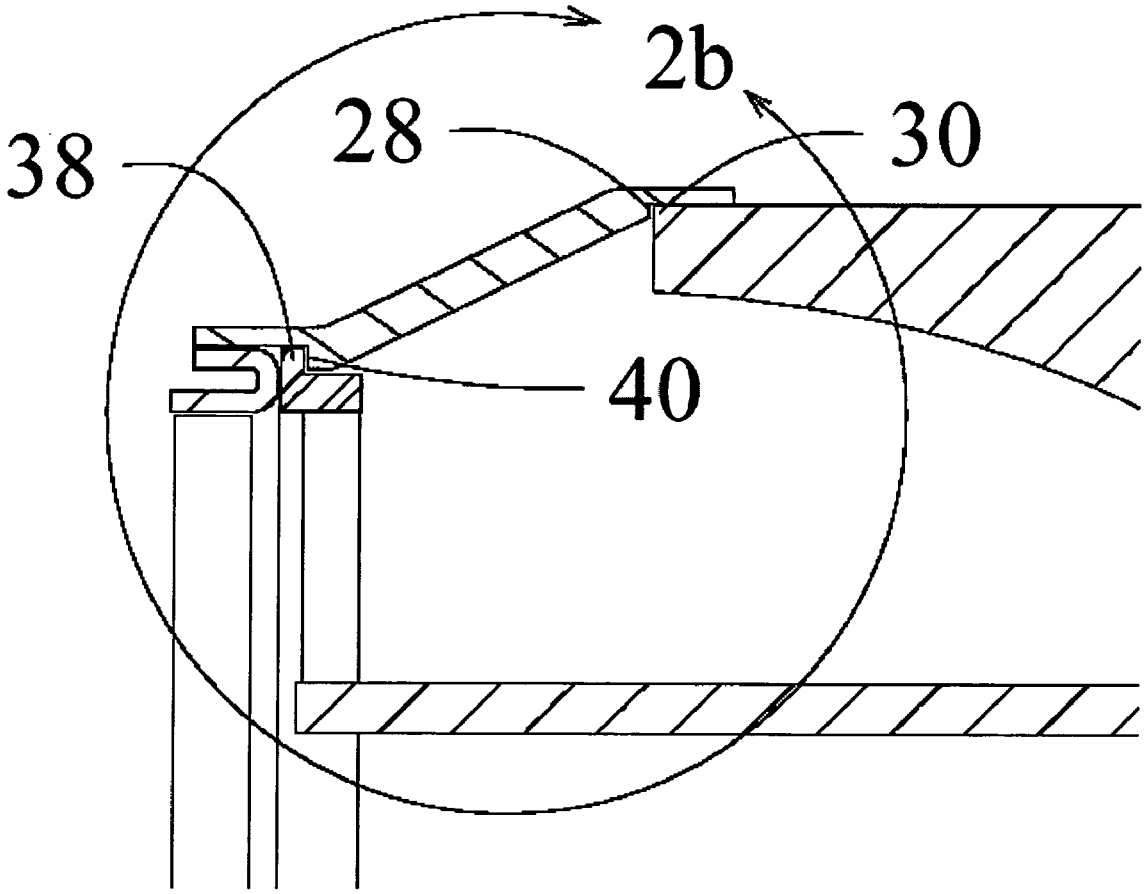
FIG. 2*b* is an expanded side section view of the lamp shown in FIG. 2*a;*

A front sleeve 25 with a first cylindrical end 26 is received over the first end of the reflector body. The sleeve incorporates a step 28 which engages a land 30 on the first end of the reflector body as best seen in FIG. 2*b*. A second cylindrical end 32 of the front sleeve receives the cathode support structure 34 and the window mount 36. The cathode support includes a ring 38 which engages a second step 40 in the second end of the sleeve. The second step is oriented oppositely from the first step thereby providing an accurate dimensional reference for positioning of the cathode support structure with respect to the reflector body. A web 42, which is conical in the embodiment shown in the drawings, interconnects the first and second cylindrical ends of the sleeve.

In the embodiment shown in the drawings, the window mount provides a U-shaped cross-section with an inner leg 44 closely receiving the window 46 which is of standard configuration made of sapphire for the embodiments disclosed herein. The outer leg 48 of the U closely engages the inner surface of the sleeve while the bottom of the U abuts the ring of the cathode support structure. Insertion of the ring into the sleeve to abut the step followed by insertion of the window mount to engage the ring urging it against the step and welding of the outer leg of the mount to the sleeve provides a subassembly with high dimensional accuracy. Inserting the reflector body into the sleeve until engaged by the first step automatically centers and axially positions the cathode within the reflector cavity without the use of centering tooling. This eliminates the potential occurrence of cathode damage or contamination during final assembly of the lamp. The sleeve is then brazed to the body to complete the assembly.

Base 20 supporting the anode is cylindrical with a flange 50 for engaging the rear surface 52 of the second end of the reflector body. The flange is brazed to the surface for structural assembly and may be accomplished at the same time as the sleeve brazing. Braze tooling is employed to center the anode and base. The anode is inserted into the base bore and bottoms out on the flat bottom of the bore. The simple structure allows gravity and tooling weight to hold the anode in place while the anode height and base depth define the assembly length. The geometry of the base allows simplified mechanical attachment of the heat exchanger, as will be described in detail subsequently.

The base is fabricated from material having high heat conduction capability. For exemplary embodiments, the base is copper or copper alloy such as OFHC copper or Glidcop, a registered alumina dispersed copper material from SCM Metal Products. In current embodiments, the anode is fabricated from pure tungsten. The configuration of the base allows for rapid heat conduction from the region of reflector body surrounding the anode aperture. The flange conducts heat transversely while the main portion of the base conducts axially.

Figure 3A:
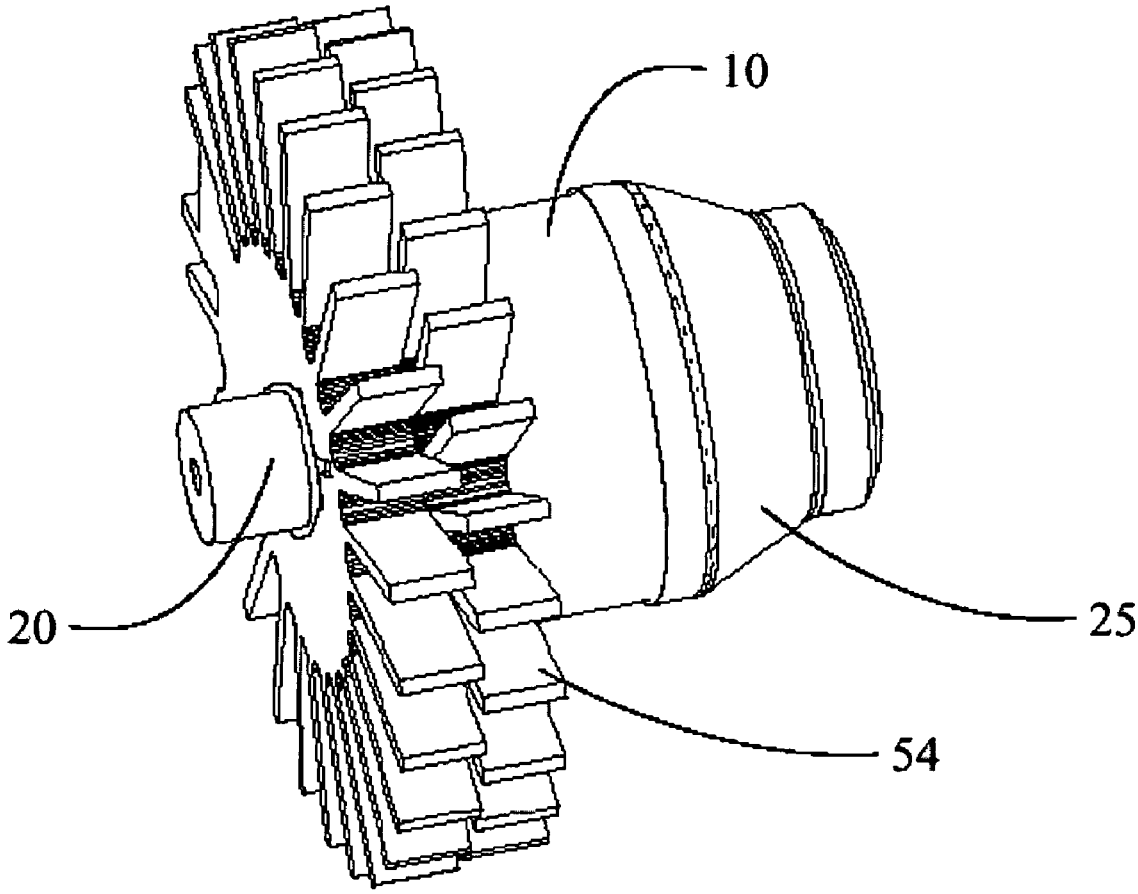
FIG. 3*a* is an isometric view of the arc lamp of FIG. 2 with an associated heat exchanger.
Figure 3B:
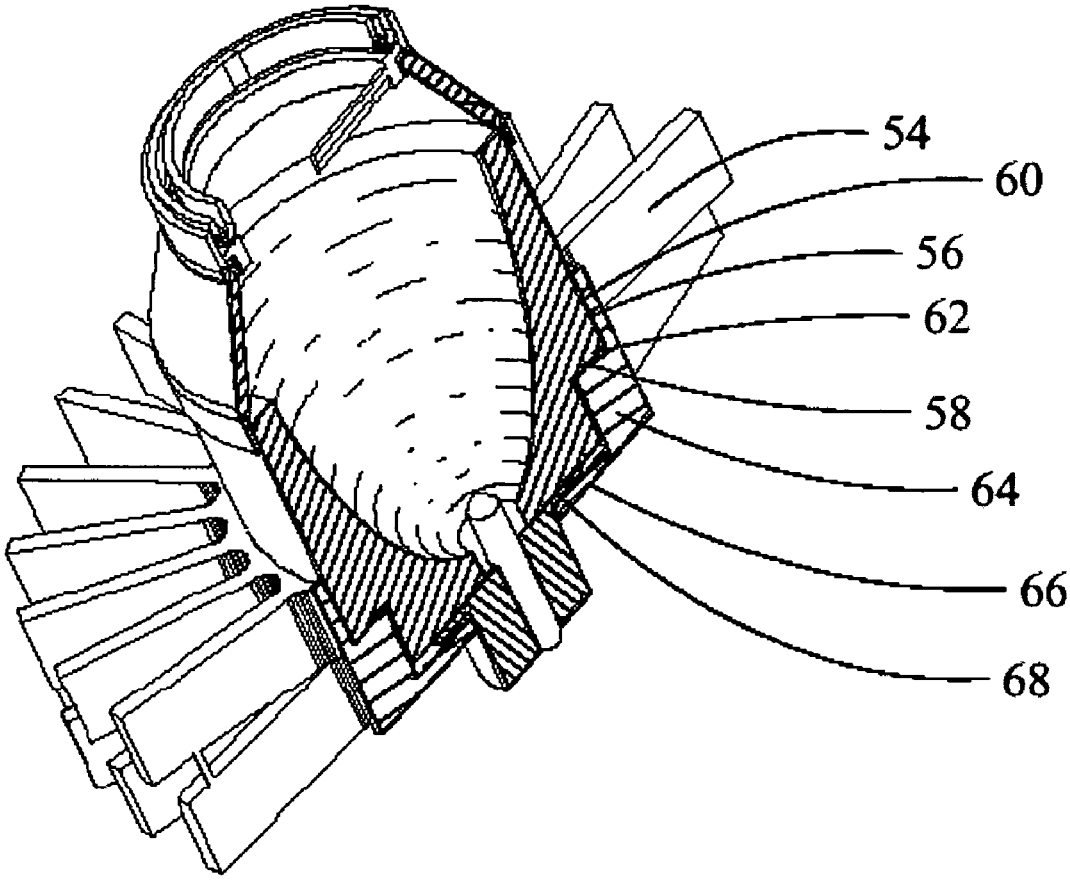
FIG. 3*b* is an isometric section view of the arc lamp of FIG. 3*a* with the associated heat exchanger.

The arrangement of the base and reflector body in the inventive lamp allows contact with a heat exchanger on multiple surfaces. As shown in FIGS. 3*a* and 3*b*, a finned heat exchanger 54 has a first cylindrical surface 56 and step 58 which interface with the diametric surface 60 and transverse surface 62 of the step in the reflector body. Extending from the first cylindrical relief is a second smaller diameter cylindrical surface 64 with its associated step 66. The cylindrical surface closely receives the main portion of the base while the step engages the back surface 68 of the flange. A thermal paste is employed for enhanced heat transfer between the flange, base and heat exchanger. In certain embodiments, the reflector body has a relief to receive the flange placing the back surface in alignment with the portion of the rear surface extending radially beyond the flange thereby allowing contact of the heat exchanger step 66 with the flange and rear surface. Alternatively, the heat exchanger step 66 has a relief to receive the flange again allowing contact with the heat exchanger along the complete radius. Structurally, the geometric arrangement of the stepped reflector body and base allows radial compressive clamping forces on the cylindrical portion of the base for securing the lamp in the heat exchanger.

Figure 4A:
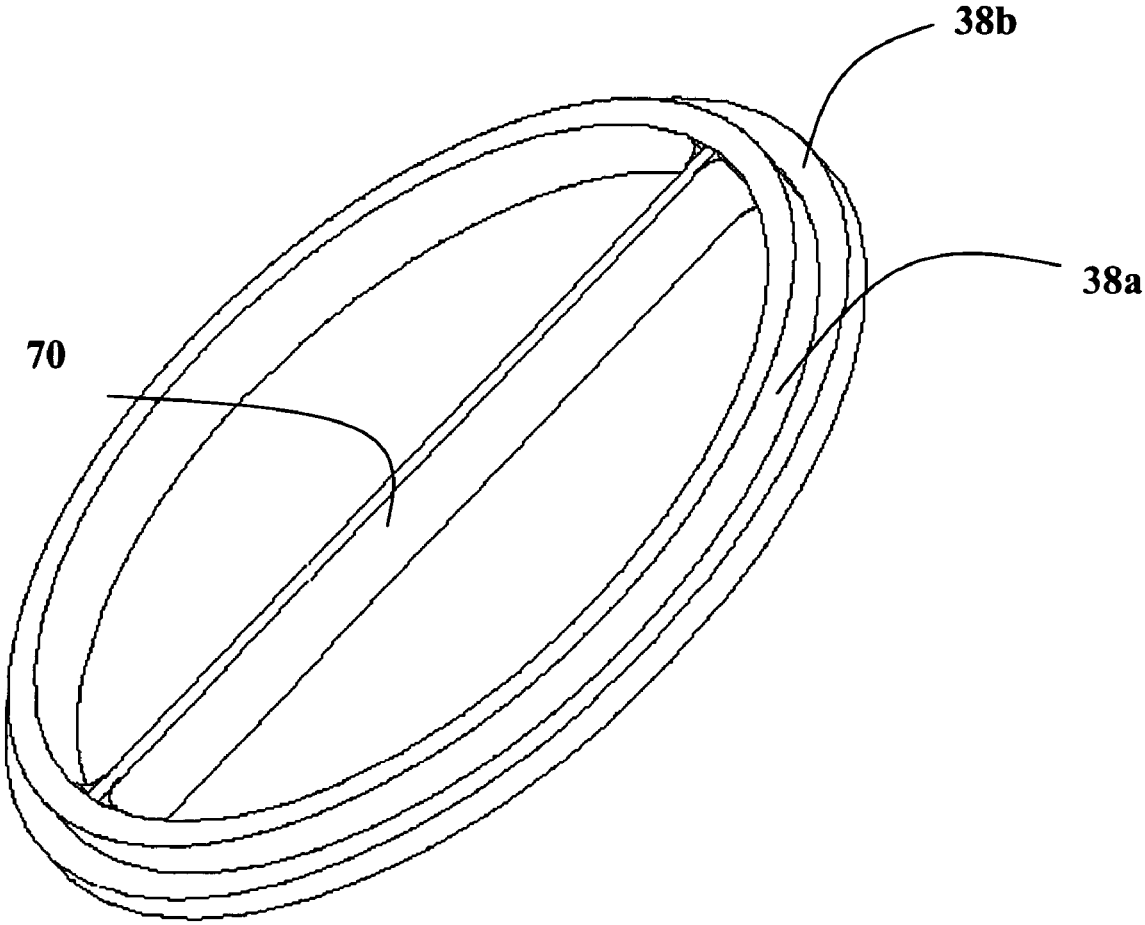
FIG. 4*a* is an isometric view of the integrated cathode support with a diametric beam.
Figure 4B:
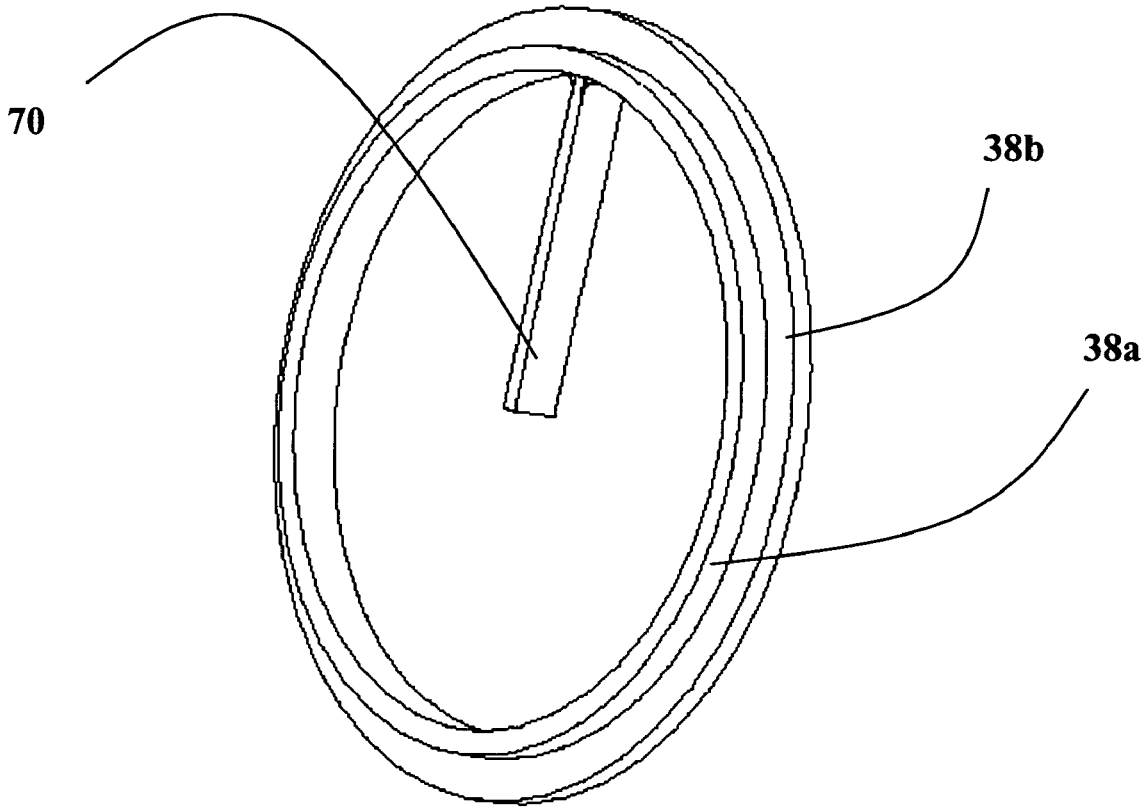
FIG. 4*b* is an isometric view of the integrated cathode support with a radial cantilevered beam.

Alternative forms of the cathode mounting structure are shown in detail in FIGS. 4*a, b* and *c*. The ring incorporates an integrally formed beam 70. The beam extends across the diameter of the ring in a first embodiment as shown in FIG. 4*a* while the beam is cantilevered, extending along a radius of the ring only to approximately the center of the ring in the embodiment shown in FIG. 4*b*. The cantilevered arrangement allows for thermal expansion of the mount without deformation of the beam. With either embodiment, the integral structure provides maximum heat conduction from the center of the beam where the cathode is mounted. Integral forming of the ring and beam is accomplished in alternative embodiments with powdered metal forming techniques. Metal injection molding and investment casting with EDM, laser or water jet machining to final dimensions are anticipated for initial embodiments.

Figure 4C:
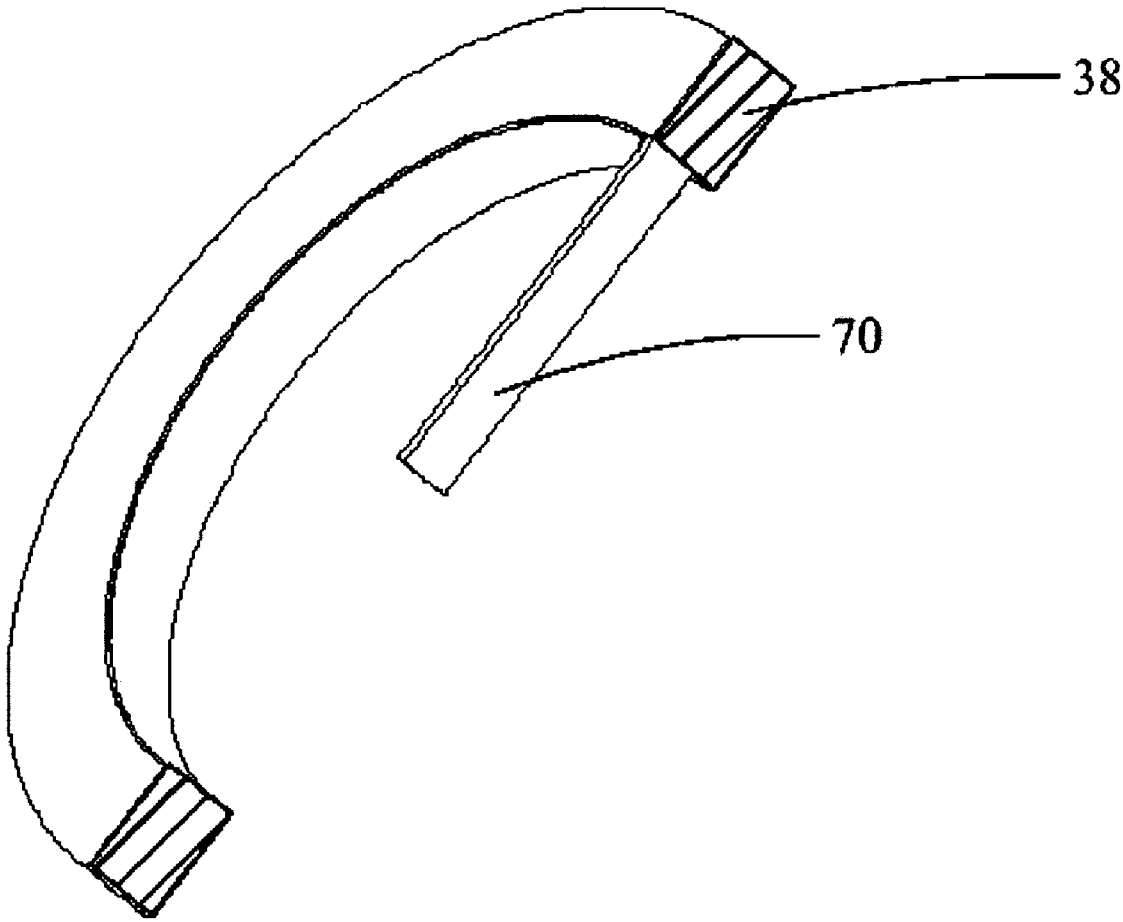
FIG. 4*c* is an isometric section view of an alternative embodiment of the cathode support.

FIG. 4*c* shows a simplified structure of the ring portion of the cathode support with a constant cross section of the ring as opposed to cylinder 38*a* and flange 38*b* of the configuration of FIGS. 4*a* and *b*. The constant cross section provides additional conductive mass for heat transfer from the beam.

Figure 5:
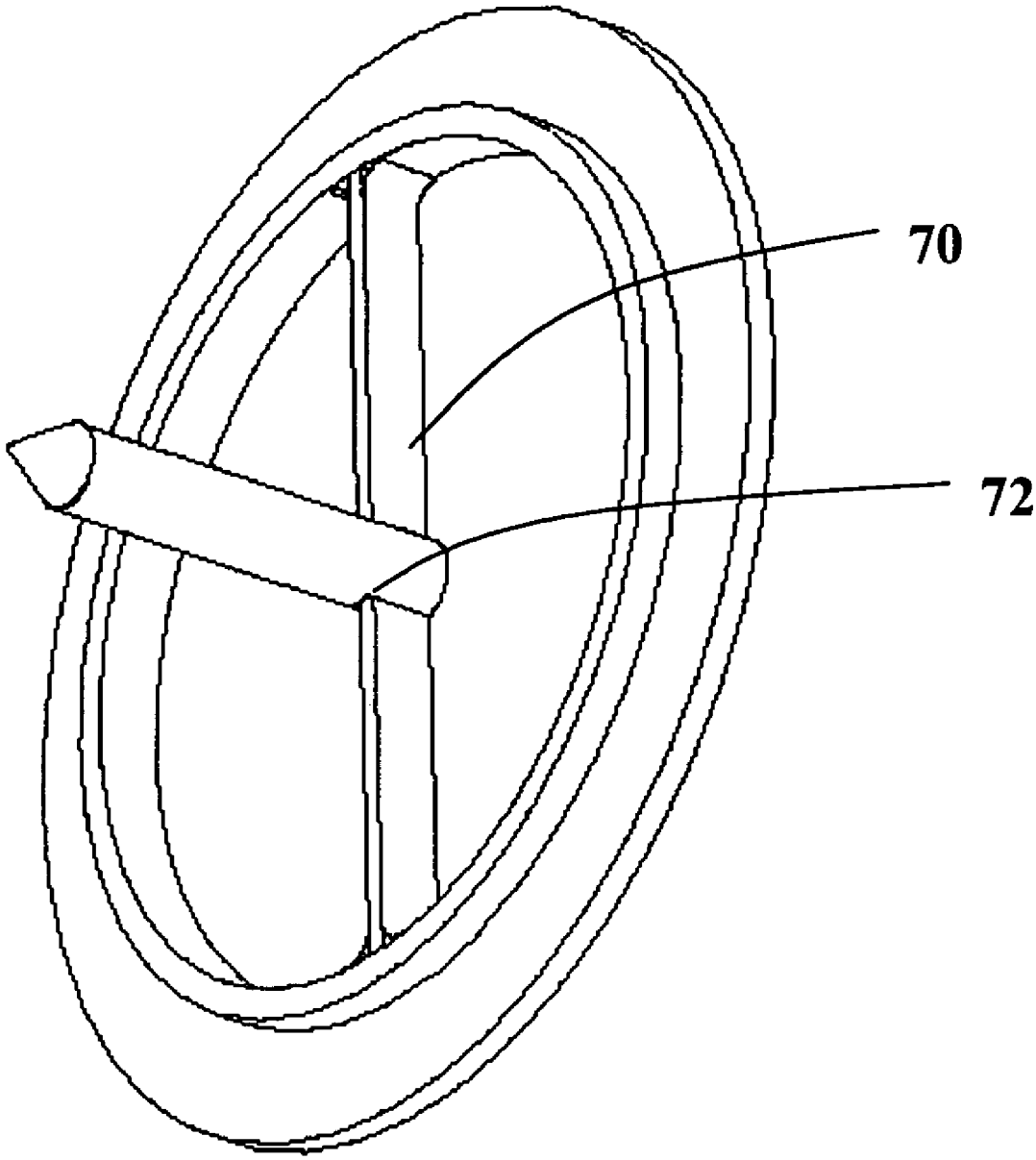
FIG. 5 is an isometric view of the integrated cathode support and cathode; and, FIG. 6*a* is a side section view of the lamp of FIG. 2 showing convection and getter location; and, FIG. 6*b* is a rear section view of the lamp along line 6*b* in FIG. 6*a*.

The cathode, as shown in FIG. 5 employs a slot 72 which is received over the beam. Precision machining of the slot allows mounting of the cathode to the beam with minimal tooling and by employing a precise depth in the slot the positioning of the cathode with respect to the anode provides a precision arc gap when used in conjunction with the opposing steps on the sleeve as previously described.

Figure 6A:
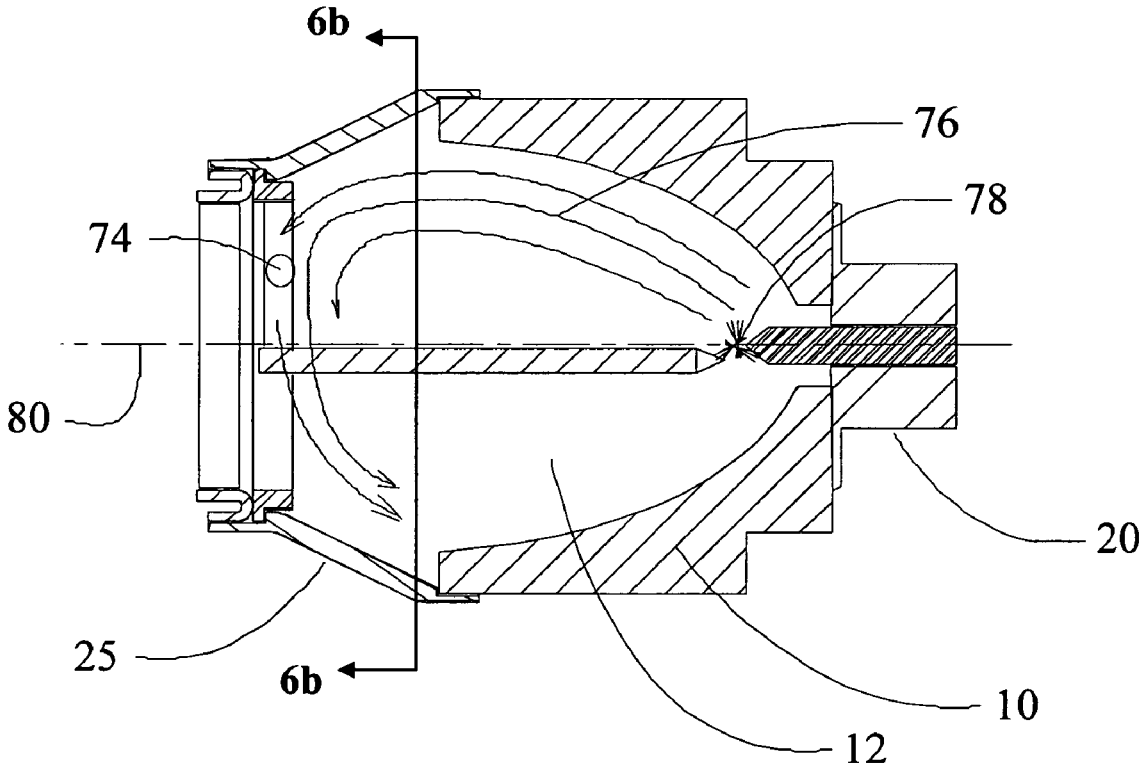
Figure 6B:
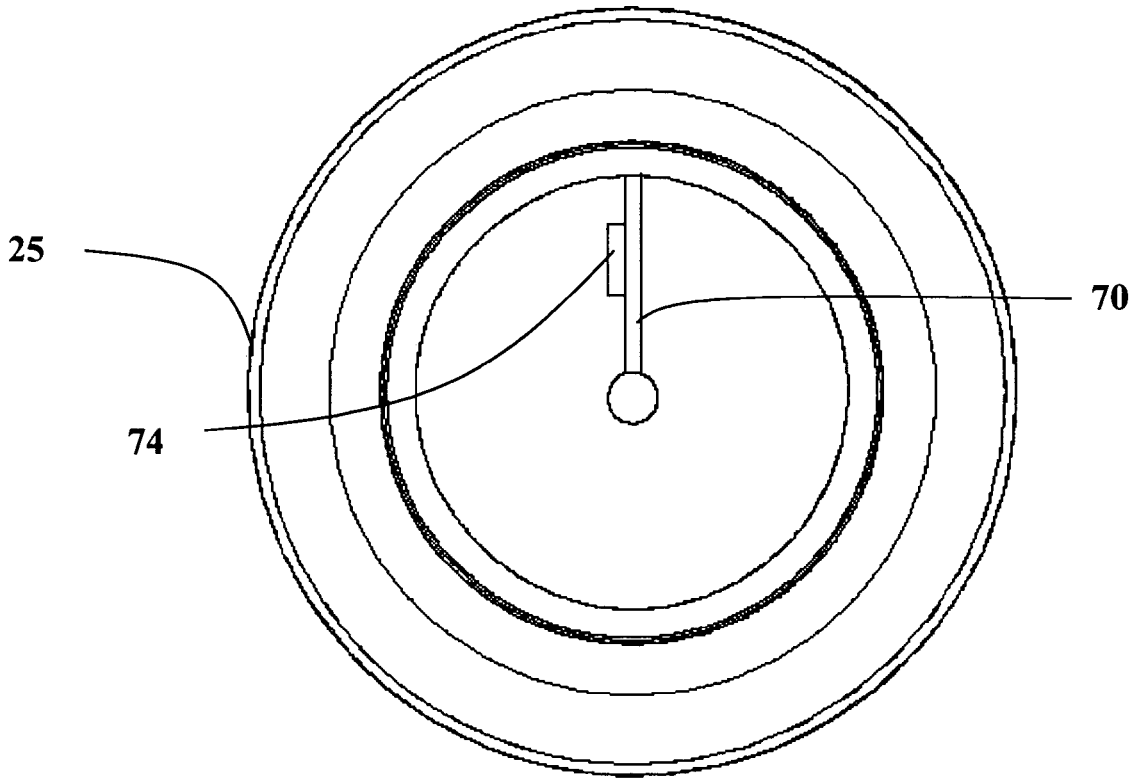

The lamp in service is mounted with the axis of the lamp in a substantially horizontal position as shown in FIG. 6*a*. The vertical arrangement of the cathode support beam provides positioning for a getter 74 as shown in FIGS. 6*a* and 6*b*. A getter such as the tablet getters produced by SAES Getters S.p.A. under part number ST 101/DF have been found suitable in various embodiments of the present invention. The convection stream within the lamp, represented by arrows 76 from the arc 78, creates a very rapid flow across the getter to enhance extraction of contaminants from the gas resulting in longer life, less darkening of the window and easier ignition of the lamp.

Additionally as shown in FIGS. 6*a* and 6*b*, the slotted attachment arrangement of the cathode in the present invention allows positioning of the cathode along the support. The tip of the cathode is placed slightly below the axis of the lamp (as exaggerated in FIG. 6*a* for clarity) to provide lifting of the arc by the convection flow whereby the arc is substantially centered on the lamp axis and the reflector axis 80. For the embodiment shown in the drawings, the cathode is parallel to the axis and offset by the tip offset. In alternative embodiments, the cathode is angled slightly downward from the attachment slot at the cathode base opposite the tip on the center axis to the off axis position of the tip.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A short arc lamp comprising:

a substantially cylindrical reflector body having a reflector cavity opening to a first end and an anode aperture through a base surface at a second end;

a front sleeve having a first end closely received over the first end of the reflector body, the sleeve first end having a step for positional engagement of a land on the first end of the reflector body, and a second end having a second positioning step oriented in opposed relation to the first step;

a cathode support received within the second end of the front sleeve and including a ring having a second land engaging the second positioning step;

a window mount received within the second end of the front sleeve and abutting a front surface of the ring; and, a highly conductive base concentrically supporting an anode received through the anode aperture, the base having a flange in flush abutment with the base surface for braze attachment thereto.

2. A short arc lamp as defined in claim 1 wherein the reflector body incorporates a step proximate the second end with substantially perpendicular transverse and diametric surfaces and further comprising a heat exchanger having first cylindrical aperture and step to closely receive the diametric and transverse surfaces of the reflector body step and second cylindrical aperture concentric with and extending from the first cylindrical aperture and having a second step to closely receive the base and flange respectively.

3. A short arc lamp as defined in claim 1 wherein the cathode support incorporates a beam integrally formed with the ring and extending across a radius thereof, and further comprising a cathode having a slotted end, the beam received within the slotted end for mounting of the cathode.

4. A short arc lamp as defined in claim 3 wherein the beam extends vertically downward from the ring and further comprising a getter attached to the beam intermediate the cathode and the ring and within a convection stream in the reflector body.

5. A short arc lamp as defined in claim 3 wherein the beam extends vertically downward and a tip of the cathode is positioned proximate the anode and below a central axis of the reflector for convection lifting of the arc.

6. A short arc lamp comprising:

a substantially cylindrical ceramic reflector body having a reflector cavity opening to a first end and an anode aperture through a base surface at a second end, the body further having a step proximate the second end with perpendicular transverse and diametric surfaces;

a front sleeve having a first end closely received over the first end of the reflector body, the sleeve first end having a step for positional engagement of a land on the first end of the reflector body, and a second end having a second positioning step oriented in opposed relation to the first step and the cathode support includes a ring having a second land engaging the second position step;

a cathode support received within the second end of the front sleeve;

a window mount received within the second end of the front sleeve and abutting the cathode support;

a highly conductive cylindrical base concentrically supporting an anode received through the anode aperture, a flange extending from the base in flush abutment with the base surface for braze attachment thereto; and, a heat exchanger having first cylindrical aperture and step to closely receive the diametric and transverse surfaces if the reflector body step and second cylindrical aperture concentric with and extending from the first cylindrical aperture and having a second step to closely receive the base and flange respectively.

7. A short arc lamp as defined in claim 6 wherein the cathode support incorporates a beam internally formed with the ring and extending across a radius thereof, and further comprising a cathode having a slotted end, the beam received within the slotted end for mounting of the cathode.

8. A short arc lamp as defined in claim 7 wherein the beam extends vertically downward from the ring and further comprising a getter attached to the beam intermediate the cathode and the ring and within a convection stream in the reflector body.

9. A short arc lamp as defined in claim 7 wherein the beam extends vertically downward and wherein a tip of the cathode is positioned proximate the anode and below a central axis of the reflector for convection lifting of the arc.

10. A short arc lamp comprising:

a substantially cylindrical reflector body having a reflector cavity opening to a first end and an anode aperture through a base surface at a second end;

a front sleeve having a first end closely received over the first end of the reflector body, the sleeve first end having a step for positional engagement of a land on the first end of the reflector body, and a second end having a second positioning step oriented in opposed relation to the first step;

a cathode support received within the second end of the front sleeve and including a ring having a second land engaging the second positioning step;

a window mount received within the second end of the front sleeve and abutting a front surface of the ring; and, a base attached to the second end of the reflector body and supporting an anode received through the anode aperture.

11. An arc lamp as defined in claim 10 wherein the base is highly conductive and concentrically supports an anode received through the anode aperture, the base having a flange in flush abutment with the base surface of the reflector body for braze attachment thereto.

12. A short arc lamp as defined in claim 11 wherein the reflector body incorporates a step proximate the second end with substantially perpendicular transverse and diametric surfaces and further comprising a heat exchanger having first cylindrical aperture and step to closely receive the diametric and transverse surfaces of the reflector body step and second cylindrical aperture concentric with and extending from the first cylindrical aperture and having a second step to closely receive the base and flange respectively.

13. A short arc lamp as defined in claim 11 wherein the cathode support incorporates a beam integrally formed with the ring and extending across a radius thereof, and further comprising a cathode having a slotted end, the beam received within the slotted end for mounting of the cathode.

14. A short arc lamp as defined in claim 13 wherein the beam extends vertically downward from the ring and further comprising a getter attached to the beam intermediate the cathode and the ring and within a convection stream in the reflector body.

15. A short arc lamp as defined in claim 13 wherein the beam extends vertically downward and further comprising a cathode mounted to the beam, a tip of the cathode proximate the anode and below a central axis the reflector for convection lifting of the arc.

16. A short arc lamp comprising:

a substantially cylindrical reflector body having a reflector cavity opening to a first end and an anode aperture through a base surface at a second end;

a front sleeve having a first end closely received over the first end of the reflector body and a second end;

a cathode support including a ring received within the second end of the front sleeve and a single beam integrally formed with the ring and depending vertically therefrom across a radius thereof;

a cathode mounted to the beam, wherein a tip of the cathode is positioned proximate the anode and below an axis of symmetry of the reflector body;

a window mount received within the second end of the front sleeve and abutting a front surface of the ring; and, a base attached to the second end of the reflector body and supporting an anode received through the anode aperture.

17. An arc lamp as defined in claim 16 wherein the base is highly conductive and concentrically supports the anode received through the anode aperture, the base having a flange in flush abutment with the base surface of the reflector body for braze attachment thereto.

18. A short arc lamp as defined in claim 17 wherein the reflector body incorporates a step proximate the second end with substantially perpendicular transverse and diametric surfaces and further comprising a heat exchanger having first cylindrical aperture and step to closely receive the diametric and transverse surfaces of the reflector body step and second cylindrical aperture concentric with and extending from the first cylindrical aperture and having a second step to closely receive the base and flange respectively.

19. A short arc lamp as defined in claim 16 further comprising a getter attached to the beam intermediate the cathode and the top and within a convection stream in the reflector body.

20. A short arc lamp comprising:

a substantially cylindrical reflector body having a reflector cavity opening to a first end and an anode aperture through a base surface at a second end;

a front sleeve having a first end closely received over the first end of the reflector body, the sleeve first end having a step for positional engagement of a land on the first end of the reflector body, and a second end having a second positioning step oriented in opposed relation to the first step and the cathode support includes a ring having a second land engaging the second positioning step;

a cathode support received within the second end of the front sleeve and having a beam extending vertically downward from the ring across a radius thereof;

a cathode mounted to the beam;

a getter attached to the beam intermediate the cathode and the ring and within a convection stream in die reflector body;

a window mount received within the second end of the front sleeve and abutting a front surface of the ring; and, a base attached to the second end of the reflector body and supporting an anode received through the anode aperture.

21. A short arc lamp as defined in claim 20 wherein the cathode has a slotted end, the beam received within the slotted end for mounting of the cathode.

22. A short arc lamp as defined in claim 20 wherein a tip of the cathode proximate the anode is below a central axis of the reflector for convection lifting of the arc.

23. An arc lamp as defined in claim 20 wherein the base is highly conductive and concentrically supports the anode, the base having; a flange in flush abutment with the base surface of the reflector body for braze attachment thereto.

24. A short arc lamp as defined in claim 23 wherein the reflector body incorporates a step proximate the second end with substantially perpendicular transverse and diametric surfaces and further comprising a heat exchanger having first cylindrical aperture and step to closely receive the diametric and transverse surfaces of the reflector body step and second cylindrical aperture concentric with and extending from the first cylindrical aperture and having a second step to closely receive the base and flange respectively.

25. A short arc lamp comprising:

a substantially cylindrical reflector body having a reflector cavity opening to a first end and an anode aperture through a base surface at a second end;

a base attached to the second end of the reflector body and supporting an anode received through the anode aperture a front sleeve having a first end closely received over the first end of the reflector body and a second end;

a cathode support received within the second end of the front sleeve having a beam extending vertically downward from a top across a radius thereof;

a cathode mounted to the beam, a tip of the cathode proximate the anode and below an axis of symmetry of the reflector body for convection lifting of the arc;

a window mount received within the second end of the front sleeve and abutting a front surface of the ring.

26. A short arc lamp as defined in claim 25 wherein the ring has a substantially constant cross section.

* * * * *